US006561737B1

(12) United States Patent
Svedman et al.

(10) Patent No.: US 6,561,737 B1
(45) Date of Patent: May 13, 2003

(54) ARRANGEMENT FOR POST PREPARATION OF AN INJECTION COMPOUND

(75) Inventors: Kjell Svedman, Ånge (SE); Mats Bränström, Härnösand (SE)

(73) Assignee: Senad Teknikbetong AB, Ange (SE)

( * ) Notice: Subject to any disclaimer, the term of this patent is extended or adjusted under 35 U.S.C. 154(b) by 0 days.

(21) Appl. No.: 09/857,932

(22) PCT Filed: Dec. 10, 1999

(86) PCT No.: PCT/SE99/02313

§ 371 (c)(1),
(2), (4) Date: Oct. 5, 2001

(87) PCT Pub. No.: WO00/35645

PCT Pub. Date: Jun. 22, 2000

(30) Foreign Application Priority Data

Dec. 11, 1998 (SE) ..... 9804296

(51) Int. Cl.[7] ..... B28C 1/08; B28C 5/00
(52) U.S. Cl. ..... 405/269; 405/267
(58) Field of Search ..... 405/55, 57, 129.45, 405/129.4, 129.35, 258.1, 263, 265, 266, 267, 268, 269

(56) References Cited

U.S. PATENT DOCUMENTS 5,734,988 A * 3/1998 Alexander et al. ..... 405/129.45
5,776,244 A * 7/1998 Ahrens ..... 106/672
5,968,257 A * 10/1999 Ahrens ..... 106/672

FOREIGN PATENT DOCUMENTS

DE 578134 C 6/1933
EP 0498279 A1 8/1992

OTHER PUBLICATIONS

Patent Abstracts of Japan, abstract of JP 10–72941 A (Sho Constr. Co. et al), Mar. 17, 1998.

* cited by examiner

*Primary Examiner*—Frederick L. Lagman
(74) *Attorney, Agent, or Firm*—Ware, Fressola, Van der Sluys & Adolphson LLP

(57) ABSTRACT

This invention relates to a method of post preparation of an injection compound which is useable for injection in for instance existing rock cracks or cracks arisen in connection with blasting away rock during for instance tunnel driving, the injection compound having been subject to a preparation, leading to that the injection compound has been given qualities with regard to shape of the crack formations of the rock. According to the invention, the method is characterized in that the injection compound is subjected to a post preparation in the form of a passage through a wire netting, the size of the mesh and the wire dimension of which being determined from a judgement of the following points: the size of the cracks and the cavities in the rock; the tendency of the injection compound to build up filter cakes; desired rheological qualities of the injection compound. The invention also relates to a device for making the method possible.

2 Claims, 1 Drawing Sheet

ARRANGEMENT FOR POST PREPARATION OF AN INJECTION COMPOUND

BACKGROUND OF THE INVENTION

1. Technical Field

This invention relates to a method and arrangement for post preparation of an injection compound which is useable for injection into for instance existing rock cracks or cracks arisen in connection with blasting away rock during for instance tunnel driving, the injection compound having been subjected to a preparation, leading to that the injection compound has been given qualities with regard to the shape of the crack formations of the rock.

2. Description of the Background Art

In spite of the fact that the injection compound has been given qualities in relation to the shape of the crack formations of the rock, problems have appeared to arise with the tightening when injecting the injection compound in the rock This fact depends upon what is happening with the injection compound during the time period passing between the preparation and the injection itself of the prepared compound. In this connection, the following reasons have been able to be verified:

A not desired temperature increase during the preparation in a mixer;

Chemical reactions and viscosity changes after the mixing;

Handling problems during the transfer from the mixer to the pump;

Pressure and streaming problems in the pump and tubes which can result in agglomerate formations, whereby the risk is that big particle agglomerates and for instance ettringite formations will follow into the rock cracks and plug up these ones.

SUMMARY OF THE INVENTION

The mentioned problems have been eliminated by the present invention which includes the moment that the injection compound is subjected to a post preparation comprising the step that the injection compound with a flow and a pressure adapted to the same is forced to pass through a wire netting, which has been chosen according to the following criteria:

Assumption of the size of the cracks and cavities in the rock;

The tendency of the injection compound to build up filter cakes;

Desired streaming of the injection compound through the gaps;

The reological qualities of the injection compound.

BRIEF DESCRIPTION OF THE DRAWING

A device for making the invention possible shall be described more closely below with reference to the accompanying drawing, where.

DETAILED DESCRIPTION OF THE INVENTION

Figure 1:
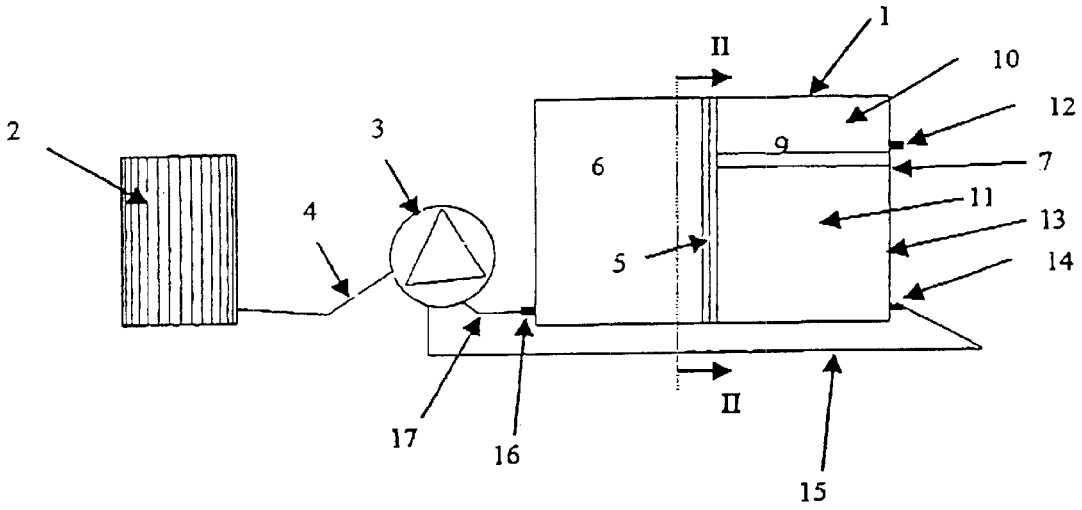
FIG. 1 shows a schematic picture of the device, connected with a concrete mixer via a pump.
Figure 2:
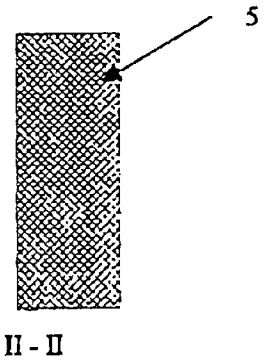
FIG. 2 shows a section through the device according to the invention, taking along the line II—II.

As is apparent from the drawing, the device comprises a working apparatus 1, which is connected with a mixer 2 for concrete or the like by means of a pump 3 via a conduit 4. The apparatus 1, which preferably has a rectangular cross-section, comprises a closed space which approximately at its central portion is divided by means of a vertically placed netting 5, which essentially fills out the vertical cross-section of the apparatus. Due to that fact two chambers 6, 7 are created, which accordingly are separated by the mentioned netting 5. In the upper portion of the chamber 7 is positioned a horizontal, intermediate wall 9 which divides the chamber 7 in an upper part 10 and a lower part 11. A first outlet connection 12 is made in the outer wall 13 of the upper chamber part 10, which connection 12 is in communication with an adapter fastened in the rock for use when pumping injection compound into the rock. A second outlet connection 14 is made in the outer wall 13 of the lower chamber part 11 and this connection is connected with a pump 3 via a conduit 15. In the lower part of the first chamber 6 is arranged an inlet connection 16 which connected with the pump 3 via a conduit 17 and through which injection compound is intended to be pumped into the chamber 6. However, the pump 3 can be reversed so that the injection compound is pumped into the chamber 6 via the "outlet connection" 14, which now functions as an "inlet connection", and the lower chamber part 11 for possible dividing filter cakes on the wire netting into pieces.

Figure 3:
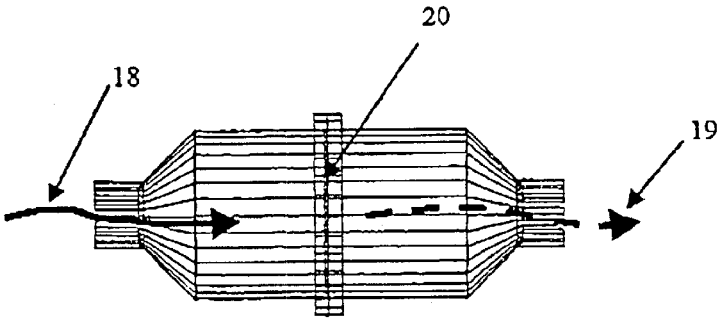
FIG. 3 shows an alternative embodiment of the device according to the invention.

In FIG. 3 is shown an alternative embodiment of the working apparatus according to the invention. In this connection the injection compound is intended to be pumped into the same at the arrow is and out of the same at the arrow 19 after having passed through a wire netting 20.

The size of the mesh and the wire dimension of the wire netting 5, 20 are determined from desired reological and other qualities of the injection compound, which is intended to be pumped into the rock, The working apparatus 1 according to the invention can suitably be connected to the tube which is intended to bring the injection compound to the adapter in the rock or in direct connection between tube and adapter.

When using the mentioned method according to the invention, the procedure is the following:

Firstly, the recepture of the injection compound is determined from the result which has appeared during the geological investigations which have been made of the rock.

An example of the result of the geological investigation can be the following:

Cracks with a gap width larger than x $\mu$m ought to be tightened;

The bore depth and the bore diameter are determined;

Water flow and water pressure result in that a counter pressure of y bar arises in the bore hole of the rock;

The amount of cracks is determined by a control of the flow of a pilot liquid from one hole to another hole, positioned at a certain distance from the first-mentioned one.

The size of the cement particles is determined in that way that these ones shall be less than the gap width of the cracks, and the size of The flow of the injection compound is determined from the amount of cracks. The pressure of the injection compound shall of course exceed the counter pressure of the water in the cracks of the rock, whereby there is created a so called differential pressure.

The injection compound is pumped into the first chamber 6 of the working apparatus 1 via the inlet connection 16, the injection compound being allowed to pass the wire netting 5 and via the first outlet connection 12 towards the cracks of the rock. Due to the passage of the wire netting 5 no larger particles or agglomerates of particles will come up to the cracks of the rock.

If a filter cakes should be formed towards the upper part of the wire netting 5, the pump pressure will be reduced to a value which is lower than that of the water pressure in the rock. Due to that fact, the filter cake is divided into pieces, whereafter a return to the selected differential pressure can be made. Thus, by working in communication with the rock, it is possible to prevent formations of filter cakes.

The working apparatus 1 has a moving circle for the injection compound via the second outlet connection 14 and the conduit 15, which makes possible a breaking down of potential filter cakes on the lower part of the wire netting by reversing the pump and contributes to an increased efficiency of the apparatus.

By using the new working apparatus, the maximum size of particles and agglomerates in the injection compound can simply be determined. Furthermore, the use of the wire netting means that for instance ettringite formations in the injection compound are broken into pieces, whereby desired rheological qualities of the compound are obtained.

By the use of the new invention, it is possible to secure the quality of the injection compound intended for the purpose.

This security of quality is made by the following measures:

Composition of an injection compound which has no tendency to build up filter cakes;

Determination of the largest size of the particle agglomerate in the injection compound;

Determination of the most optimum differential pressure for getting the best ability of penetration;

Using a pump technique which is adapted to the hydrological/geotechnical parameters in the rock;

Control of the dispersing level of the injection compound in relation to the stability during the production phase.

The use of the new invention means that particle agglomerates are not filtrated away but are reprepared (are formed) to less agglomerates of a size predetermined by the size of the mesh of the wire netting. Due to that fact it is possible to get an injection compound with predetermined qualities for pumping the same into for instance holes and cracks in rocks.

From the above-mentioned text appears that this new invention makes possible to produce an injection compound which has the most suitable qualities for bringing about the best penetration into and the best tightening of holes and cracks which arise in a certain type of rocks.

In the text of the patent application, as an example, has been mentioned tightening of cracks and holes in rocks. Of course, within the scope of the invention falls the utilization of the invention for another tightening, for instance of holes and cracks in objects of concrete.

What is claimed is:

1. A device for post preparation of an injection compound which is useable for injection into for instance existing crack formations and cavities in rock arisen in connection with blasting away rock during for instance tunnel driving, the device being connected with a pump intended to pump an injection compound thereto, the device comprising:

(a) an enclosure defining a space; and (b) a wire netting essentially covering a cross-section of the space, the wire netting divides the space into a first chamber and a second chamber, the pump is connected with the first chamber via a first conduit and a first connection, the second chamber is divided into an upper part and a lower part, the upper part is provided with a second connection, and the lower part is provided with a third connection, the wire netting having mesh size and wire dimension determined from:

the size of the cracks and the cavities in the rock;

the tendency of the injection compound to build up filter cakes; and desired rheological qualities of the injection compound.

2. A device according to claim 1, wherein the third connection in the lower part is connected with the pump via a second conduit, and the pump is reversible so that the injection compound can flow into the space via the third connection to remove coverings from the wire netting.

* * * * *